United States Patent [19]

Klaus

[11] Patent Number: 4,514,792

[45] Date of Patent: Apr. 30, 1985

[54] LIGHTING FIXTURE WITH TRIPLE INSULATING MEANS

[75] Inventor: Dale A. Klaus, Chesterfield, Mo.

[73] Assignee: International Export Company, St. Louis, Mo.

[21] Appl. No.: 569,037

[22] Filed: Jan. 9, 1984

[51] Int. Cl.[3] ..... F21V 29/00

[52] U.S. Cl. ..... 362/294; 362/373; 362/147

[58] Field of Search ..... 362/294, 373, 147, 370, 362/368, 311, 361, 355

[56] References Cited

U.S. PATENT DOCUMENTS

| | | | |
|---|---|---|---|
| 2,638,531 | 5/1953 | Levy | 362/382 |
| 4,044,246 | 8/1977 | Docimo et al. | 362/294 |
| 4,356,540 | 10/1982 | Goralnik | 362/147 X |

*Primary Examiner*—Stephen C. Bentley
*Assistant Examiner*—John S. Maples
*Attorney, Agent, or Firm*—Senniger, Powers, Leavitt and Roedel

[57] ABSTRACT

A lighting fixture adapted to be mounted on a ceiling by attachment to an outlet box in the ceiling. The fixture comprises a crossbar attached to the bottom of the outlet box in a position extending horizontally across the bottom of the box and of such length as to extend at both ends beyond the box. The crossbar has downwardly extending legs and generally horizontally extending feet at the lower ends of the legs. The fixture further has a plate below the crossbar with thermally insulated spacer means between the plate and the crossbar. Screws secure the plate to the crossbar with the spacer means between the plate and the crossbar. The screws extend up through holes in the plate and are threaded into holes in the feet. A light source and diffuser for the light source are secured on the bottom of the plate and to the rim of the plate, respectively.

5 Claims, 2 Drawing Figures

LIGHTING FIXTURE WITH TRIPLE INSULATING MEANS

BACKGROUND OF THE INVENTION

This invention relates to lighting fixtures of the type adapted to be mounted on a ceiling by attachment to an outlet box in the ceiling. This type of fixture is sometimes referred to in the trade as a flush-mounted ceiling fixture.

The invention is in the same general field as the lighting fixtures shown in U.S. Pat. Nos. 2,638,531, 4,104,713 and 4,234,916 and involves improvements thereover.

SUMMARY OF THE INVENTION

Among the several objects of this invention may be noted the provision of a lighting fixture of the aforementioned type which effectively reduces the amount of heat transferred from a light source within the fixture to the ceiling and the outlet box; the provision of such a fixture which is easy to attach to an outlet box; and the provision of such a fixture which is economical to manufacture.

Generally, a lighting fixture of this invention, of the aforementioned type, comprises a crossbar adapted to be attached to the bottom of the outlet box in a position extending horizontally across the bottom of the box and of such length as to extend at both ends beyond the box. The fixture further comprises a plate below the crossbar with thermally insulated spacer means between the plate and the crossbar. The crossbar has means adjacent its ends for receiving screws for securing the plate to the crossbar, and screws associated with the plate are threaded in said means for securing the plate to the crossbar with the spacer means between the plate and crossbar. A light source and diffuser for the light source are provided.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
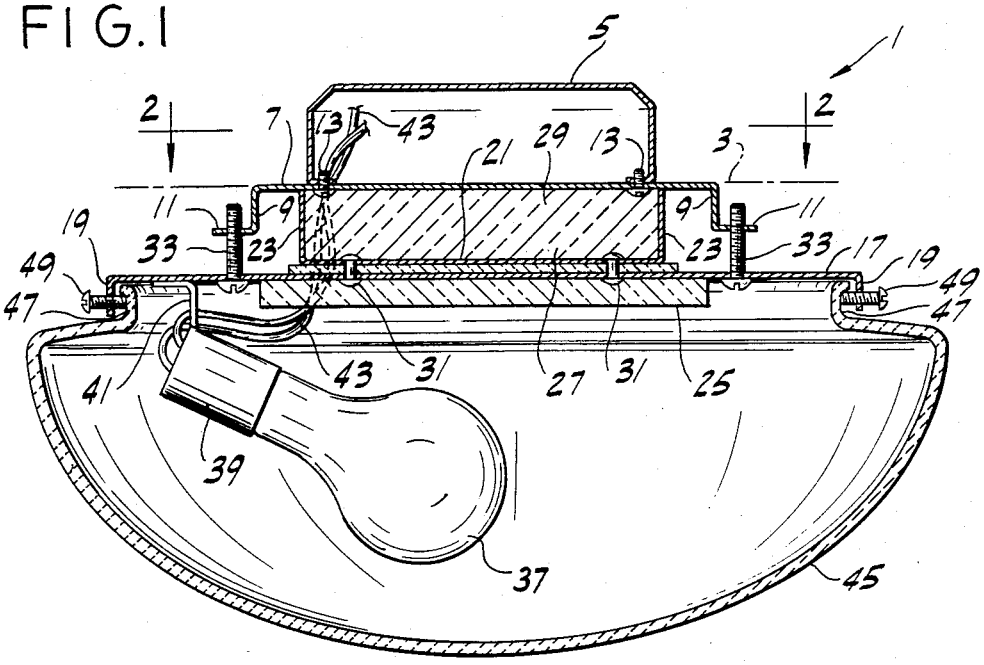
FIG. 1 is a vertical section of a lighting fixture of this invention shown mounted on a ceiling by attachment to an outlet box in the ceiling.
Figure 2:
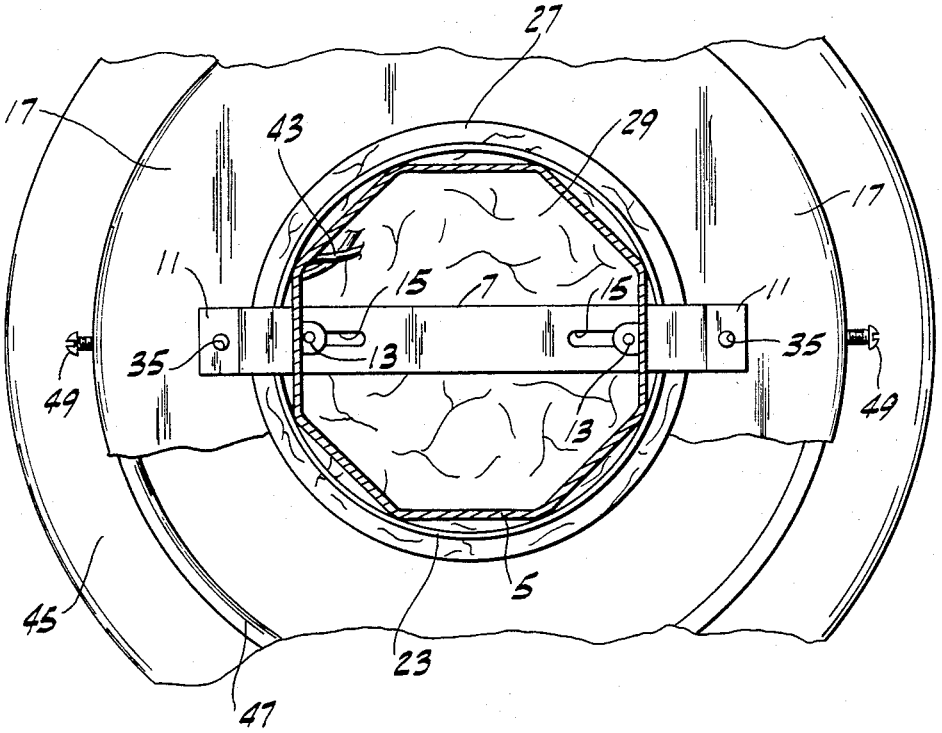
FIG. 2 is a horizontal section taken on line 2—2 of FIG. 1.

Referring to the drawings, a lighting fixture of this invention is designated generally by the reference numeral 1 and is shown mounted on a ceiling 3 by attachment to a standard junction or outlet box 5 recessed in the ceiling. The fixture 1 comprises a flat, relatively narrow crossbar 7 extending horizontally across the bottom of the outlet box 5 and laterally outward from the box beyond the opposite sides of the box generally flush with the ceiling 3. The crossbar 7 has means adjacent its ends for receiving screws for securing the plate to the crossbar comprising downwardly extending legs 9 at its ends and generally horizontally outwardly extending feet 11 at the lower ends of the legs. It will be understood, however, that the feet 11 might extend inwardly (instead of outwardly) without departing from the scope of the invention. Screws 13 extending up through a pair of elongate slots 15 in the crossbar 7 and threaded into lugs 16 at the bottom of the outlet box 5 secure the crossbar to the box.

Disposed below the crossbar 7 and indicated at 17 is a generally circular plate, the outer margin of which is bent down to form an annular lip 19. A generally circult pan 21, constituting spacer means, having an upwardly extending flange 23 at its periphery is positioned between the plate 17 and cross bar 7 and inside of legs 9 such that a gap results between the pan and each of the legs. A first batt or layer of suitable insulation 29 (fiberglass insulation, for example) is contained within the pan. A second batt 25 is positioned below the plate 17 and a third batt 27 is positioned between the top of the plate 17 and the bottom of the pan 21. Rivets 31 secure the plate 17 and the pan 21 together with the third batt therebetween, as shown in FIG. 1.

Plate 17 is secured to the crossbar 7 by means such as screws 33, with the pan 21 between the plate and the crossbar. The screws 33 extend up through holes in the plate 17 and are threaded in holes 35 in the feet 11 of the crossbar.

A conventional incandescent light bulb 37 and socket 39 are mounted below the plate 17 by means of a bracket 41 secured to the underside of the plate. As illustrated in FIG. 1, the bulb 37 is spaced away from the bottom of the plate 17. The socket 39 is connected to a suitable electrical source (not shown) via wires 43 which extend down from the outlet box 5, through the batts of insulation 25, 27 and 29 and thence down through a relatively small hole (not shown) in the plate 17 to socket 39.

Indicated at 45 immediately below plate 17 and enclosing light bulb 37 is a generally round, light-diffusing cover or diffuser which may be of glass or other suitable material. This cover 45 has a peripheral groove 47 therein toward its upper edge for receiving a plurality (e.g., four) of thumb screws, each designated 49, threaded through the downwardly extending lip 19 of plate 17 at equal intervals (e.g., four screws at 90° intervals) around the lip.

It will be observed from the foregoing that the above-described lighting fixture 1 is effective to reduce the transfer of heat from the light source (light bulb 37) upwardly to the ceiling 3 and outlet box 5. Thus, it should be noted that screws 33 fastening the plate 17 to the feet 11 and the legs 9 of the crossbar 7 constitute an elongate heat path which is exposed to the cooler air outside the lighting fixture, thereby contributing to the reduction of heat transferred to the outlet box. In addition, the layering of the insulation batts 25, 27 and 29 up from immediately above the light source 37 further contributes to the prevention of over-heating of both the ceiling 3 and the outlet box 5.

In view of the above, it will be seen that the several objects of invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A lighting fixture adapted to be mounted on a ceiling by attachment to an outlet box in the ceiling, comprising:

a crossbar adapted to be attached to the bottom of the outlet box in a position extending horizontally across the bottom of the box and of such length as to extend at both ends beyond the box, said crossbar having downwardly extending legs and generally horizontally extending feet at the lower ends of the legs, said legs and feet forming an elongate heat path for the reduction of heat transferred to the box;

a plate below the crossbar with thermally insulated spacer means between the plate and the crossbar, said spacer means being positioned inside of said legs such that a gap results between said spacer means and each of said legs for exposing said heat path to the cooler air outside said lighting fixture;

means securing the plate to the crossbar with the spacer means between the plate and the crossbar comprising screws extending up though holes in the plate threaded in holes in the feet;

a light source on the bottom of the plate; and a diffuser for the light source secured to the plate at the rim of the plate.

2. A lighting fixture as set forth in claim 1 wherein said thermally insulated spacer means is in the form of a pan and has a first insulation batt positioned in the pan thereby to reduce the transfer of heat generated by the light source to the outlet box.

3. A lighting fixture as set forth in claim 1 wherein said feet at the lower ends of the legs extend generally horizontally outwardly.

4. A lighting fixture as set forth in claim 2 wherein a second insulation batt is positioned below the plate and above said light source.

5. A lighting fixture as set forth in claim 4 wherein a third insulation batt is positioned between the top of the plate and the bottom of the pan.

* * * * *